US006041953A

United States Patent [19]

Goodall

[11] Patent Number: 6,041,953

[45] Date of Patent: Mar. 28, 2000

[54] CONTAINERS AND CLOSURES THEREFOR

[76] Inventor: Donald Terry Goodall, 30 Beach Street, Blakehurst, NSW, Australia, 2221

[21] Appl. No.: 09/035,075

[22] Filed: Mar. 5, 1998

Related U.S. Application Data

[63] Continuation-in-part of application No. 08/930,497, filed as application No. PCT/AU96/00195, Apr. 4, 1996.

[30] Foreign Application Priority Data

Apr. 5, 1995 [AU] Australia ..... PN2184
Mar. 10, 1997 [AU] Australia ..... PO5544/97

[51] Int. Cl.[7] ..... B65D 41/00

[52] U.S. Cl. ..... 215/354; 215/44; 215/45; 215/235; 215/237; 215/253; 215/254; 215/318; 215/320; 215/354

[58] Field of Search ..... 215/44, 45, 235, 215/237, 253, 254, 318, 320, 354

[56] References Cited

U.S. PATENT DOCUMENTS

| | | | |
|---|---|---|---|
| 3,556,338 | 1/1971 | Wilkinson et al. . | |
| 3,592,349 | 7/1971 | Baugh . | |
| 3,688,942 | 9/1972 | Mitchell et al. . | |
| 3,741,424 | 6/1973 | Landen . | |
| 4,496,066 | 1/1985 | Bullock, III | 215/320 |
| 4,699,285 | 10/1987 | Perne et al. . | |
| 4,712,699 | 12/1987 | Lutz . | |
| 5,207,783 | 5/1993 | Burton | 215/256 |
| 5,257,705 | 11/1993 | DeSantana . | |
| 5,402,901 | 4/1995 | Carvalheiro et al. . | |
| 5,464,112 | 11/1995 | Guillot | 215/254 |
| 5,489,036 | 2/1996 | Arkins | 215/343 |
| 5,730,309 | 3/1998 | Jiradejnunt et al. . | |

FOREIGN PATENT DOCUMENTS

| | | |
|---|---|---|
| 34026/78A | 9/1979 | Australia . |
| 79156/91A | 1/1992 | Australia . |
| 2268734 | 1/1994 | United Kingdom . |
| WO90/06266 | 6/1990 | WIPO . |

*Primary Examiner*—Stephen K. Cronin
*Attorney, Agent, or Firm*—Jacobson, Price, Holman & Stern, PLLC

[57] ABSTRACT

A container and a removable closure, the container having an outlet with an inner and outer surface terminating at one end in a rim. The closure includes an end wall with an inner and outer skirt extending therefrom, the inner and outer skirts defining between them a slot which when the closure is applied to the container receives the container rim. The inner skirt includes a sealing section, and a deflecting section in the region of the free end of the inner skirt. The cross-sectional areas of the region and the cross-sectional area of the inner surface of the outlet being such that when the closure is applied to the container the deflecting section of the inner skirt engages the inner surface of the outlet to force the inner surface of the outlet adjacent the rim into sealing engagement with the sealing zone to seal the closure to the container.

28 Claims, 14 Drawing Sheets

CONTAINERS AND CLOSURES THEREFOR

This application is a continuation-in-part of application Ser. No. 08/930,497, filed Oct. 3, 1997, which is a 371 of International Application No. PCT/AU96/00195, filed Apr. 4, 1996.

This invention relates to containers and closures therefor and is particularly suitable for use with containers made from plastics material e.g. polypropylene.

Containers and closures manufactured from material of this type have many minor surface imperfections caused by moulding operations and thermal contraction. These imperfections make it extremely difficult to effect a proper seal unless special precautions are taken and even when this is done the contents of the container sometimes leak which is highly undesirable where the container is used for pressurised fluids e.g. carbonated beverages, autoclaved and volatile fluids or body fluids used for pathological examination purposes.

In order to minimise this problem screw threaded containers and closures and sealing gaskets of various shapes have been used or complementary cone-shaped sealing surfaces for the container and closure with or without machine finish of the interengaging parts. Such sealing arrangements are costly. In some cases the closure requires considerable physical effort to lock it and unlock it from the container and as indicated even with the use of closures and containers of this type the contents of the container sometimes leak.

The present invention relates to a closure and a container which overcomes the problems previously encountered and provides a simple and inexpensive construction whereby the closure is effectively sealed and preferably locked to the container to effect a leak-proof seal with minimum effort.

Containers come in various shape and sizes, some have neck portions and some do not. It is to be understood however that the principles of the invention are applicable to both types of containers and the only qualification is that the container or neck thereof have the features herein referred to. For this reason whenever the word container is referred to hereafter it is to be understood as including the neck of a container.

According to one aspect of the present invention there is provided a container and a removable closure therefor, said container having an outlet with an inner and outer surface terminating at one end in a rim, said closure having an end wall with an inner and outer skirt extending therefrom, said inner and outer skirts defining between them a slot which when the closure is applied to the container receives the container rim, the inner skirt having a sealing section, and a deflecting section in the region of the free end of the inner skirt, the cross-sectional areas of said region and the cross-sectional area of the inner surface of the outlet being such that when the closure is applied to said container the deflecting section of the inner skirt engages the inner surface of said outlet to force the inner surface of said outlet adjacent the rim into sealing engagement with said sealing zone to seal said closure to said container.

According to yet another aspect of the present invention there is provided a container and a removable closure therefor, said container having an outlet with an inner and outer surface terminating at one end in a rim, said outlet having two regions of different cross-sectional areas joined by an inclined surface with the cross-sectional area of said region adjacent the rim being greater than the cross-sectional area of said region inwardly of said inclined surface, said closure having an inner and outer skirt connected on upper end thereof with an annular disc connecting said inner skirt and thereby forming said closure, said inner and outer skirts defining between them a slot which when the closure is applied to the container receives the container rim, the inner skirt having a sealing zone extending into said slot, the cross-sectional areas of said regions and the size of said sealing zone on said inner skirt being such that when the closure is applied to said container the outer surface of the inner skirt engages the inner surface of said outlet to force the inner surface of said outlet adjacent the rim into sealing engagement with said sealing zone to seal said closure to said container.

In one preferred embodiment the deflecting section may include a projection on the outer surface of the inner skirt in the region of the free end thereof. In a preferred form the inner and outer skirts are generally straight sided cylinders.

Preferably, the sealing section extends into the slot thereby defining a recessed zone between the sealing section and the deflecting section. There may further be provided a tapered leading edge at the free end of the inner skirt. The tapered leading edge is useful for locating the closure relative to the container during the fitting process.

According to another aspect of the present invention there is provided a container and a closure therefor, the container having an outlet with an inner and outer surface terminating at one end in a rim, the closure including an end wall having an opening therein and a hinged cap section in the end wall adapted to be hingedly moved between open and closed positions, wherein in the closed position it closes the opening in the end wall, the end wall having an inner skirt and an outer skirt extending therefrom, the inner and outer skirts defining between them a slot which when the closure is positioned on the container and the cap section is closed receives the container rim, the inner skirt having a sealing section, and a deflecting section in the region of the free end of the inner skirt, the cross-sectional areas of said region and the cross-sectional area of the inner surface of the outlet being such that when the closure is in the closed position the deflecting section of the inner skirt engages the inner surface of said outlet to force the inner surface of said outlet adjacent the rim into sealing engagement with said sealing zone to seal said closure to said container.

In a similar fashion to that of the first aspect, preferably, the deflecting section comprises a projection on the outer surface of the inner skirt. Preferably, the sealing section extends into the slot thereby defining a recessed zone between the sealing section and the deflecting section which effects a progressive release of the end cap from the container to effect a controlled release of gas from the container. There may further be provided a tapered leading edge at the free end of the inner skirt.

Primary lock means may be provided on the container which co-operate with primary lock means on the closure to lock the closure to the container. In this particular embodiment the primary lock means may include locking beads on the outer surface of the container which are adapted to co-operate with a slot on the internal surface of the outer skirt to lock the two parts together.

The closure of the present invention is preferably for non carbonated liquids, pressure release is not a factor with this closure. The recessed zone of the inner skirt outer surface forms a narrow sealing band at the upper end of the skirt. The sealing band is preferably made narrow (0.5 mm max. for example) to concentrate sealing pressure. The inward deflection of the neck wall is at a small angle that would allow the sealing load to spread along the skirt wall if it were not for this arrangement. The projection applies radial force preferably through a sharp edged which also concentrates sealing pressure.

The closure, among other more general purposes may be used with hot filled PET containers. Fruit juice and isotonic thirst quenchers are often bottled at 83 degrees centigrade to avoid using sterilising agents. The standard cap sealing face bends around the flat sealing face of the container neck rim when hot filled and tensioned, it is only pulled into the intended flat face to face sealing position by vacuum generated during cooling down of the container contents. Until this has finally happened the container is prone to draw in air to start fermentation off. This is a major problem for the fruit juice industry which the closure of the present invention alleviates.

Hot filled containers are sealed immediately upon filling with caps torqued to 20–25 in/pounds. PET threads stretch quickly at sterilising temperature reducing torque and sealing effectiveness to practically zero. Such caps are normally fitted with sealing gaskets which are ineffectual adding considerably to the cost of caps.

The closures of the present invention may be of the removable type or the non-removable type and may, for example, include a threaded section. Tile closure of the present invention may not for this particular type require any thread tension to seal and is consequently unaffected by softened threads. At sterilising temperature PET neck finishes distort. expand and the contract to a smaller than original diameter. The lower seal beds sharp edge of into the smaller diameter retaining its effectiveness as a seal despite neck bore distortion.

It is desirable for a container cap to be unscrewed sufficiently to break tamper evident band before the container is open to the atmosphere. The sharp edge of the radial flexible lower seal attached to the thin wall section of the internal skirt allows the seal to adjust to ovality when rotated during opening.

The same sealing system can be applied to large diameters e.g. 20 liter open headed plastic pails, 4 liter pain cans, and small jars. The plastic used may be high density, polypropylene or similar plastic.

In another preferred form the primary lock means provided on the container which cooperates with primary lock means on the closure to lock the closure to the container. Preferably in this form, the primary lock means comprises a threaded section on the inner surface of the outer skirt of said closure which engages a corresponding threaded section on the outer surface of said container.

According to yet another aspect of the present invention there is provided a closure as described above either in its broad or preferred forms suitable for use with a container as described above.

In those cases where pressurised fluid is housed within the container it may be desirable to provide a venting arrangement to permit the controlled release of gas as the container is opened. To this end the inner skirt of said closure is stepped inwardly below said sealing zone to form a shoulder thereby providing a secondary sealing zone which when the closure is applied to a container seals against said inclined surface. As the closure is progressively removed from the container the respective sealing zones are progressively released thereby permitting a controlled release of gas from the container.

The means to lock the closure to the container in one form comprise a threaded section of the outer skirt which engages with a complimentary threaded section on the container.

Alternatively the locking of the closure to the container may be effected by a wedging action between the closure and the container. To this end the outer skirt of the closure is provided with a frusto-conical locking skirt extending circumferentially about the bottom edge thereof and movable between an unlocked and locked position said locking skirt in the unlocked position converging towards to the outer skirt and thus presenting a smooth inner surface to the outer wall of the container thereby permitting said closure to be freely applied and removed from said container. In the locked position the locking skirt diverges away from the outer skirt with the inner bottom edge of said locking skirt forming a locking bead at its junction with the outer skirt which tightly engages the container outer wall to lock said closure to said container. Preferably the locking bead seats in a circumferential locking slot on the outer wall of the container.

In a further modification the closure and container is provided with a tamper evident structure. To this end the outer surface of the container is provided with a circumferentially outwardly extending collar positioned below the container rim, the collar having a circumferential slot in its edge thereby defining an upper and lower limb, the free end of the conical locking skirt having a tamper evident band secured thereto by a fracture line extending circumferentially around said locking skirt and having a hinge connection with said locking skirt at one side position thereof, which band in the unsecured position and in the unlocked position of said locking skirt is positioned above said collar enabling the closure to be freely applied to and removed from the container and in the locked position of said locking skirt said tamper evident sealing band seats in said slot, said tamper evident sealing band being provided with a finger tag which facilitates the fracturing of said fracturable portion and permits the cap to be pivoted about its hinge to open and close the container.

In a modification of the tamper evident structure just described, the outer surface of each side of the container is provided with two downwardly directed "V" shaped channels connected by a transverse section and positioned below and spaced from the transverse section is a transverse channel. The closure has a tamper evident skirt connected thereto by a fracture line and a lock member positioned on the inner surface of the closure and the tamper evident skirt is adapted to be accommodated in the respective transverse section and transverse channel to lock the closure to the container. Rotational movement of the closure relative to the container breaks the fracture line and permits the container to be opened and means may be provided on the container to permit the controlled release of gas from the container.

Preferred embodiments of the invention will now be described with reference to the accompanying drawings in which like parts are identified by the same reference numerals.

Figure 2:
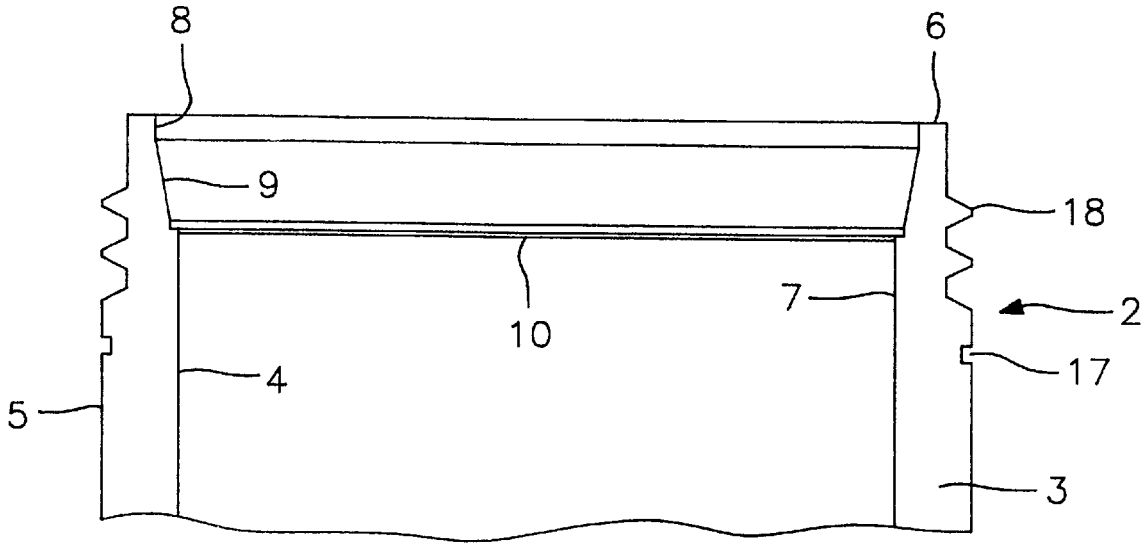
FIG. 2 is a cross-sectional view of a container for use with the closure illustrated in FIG. 1.
Figure 16:
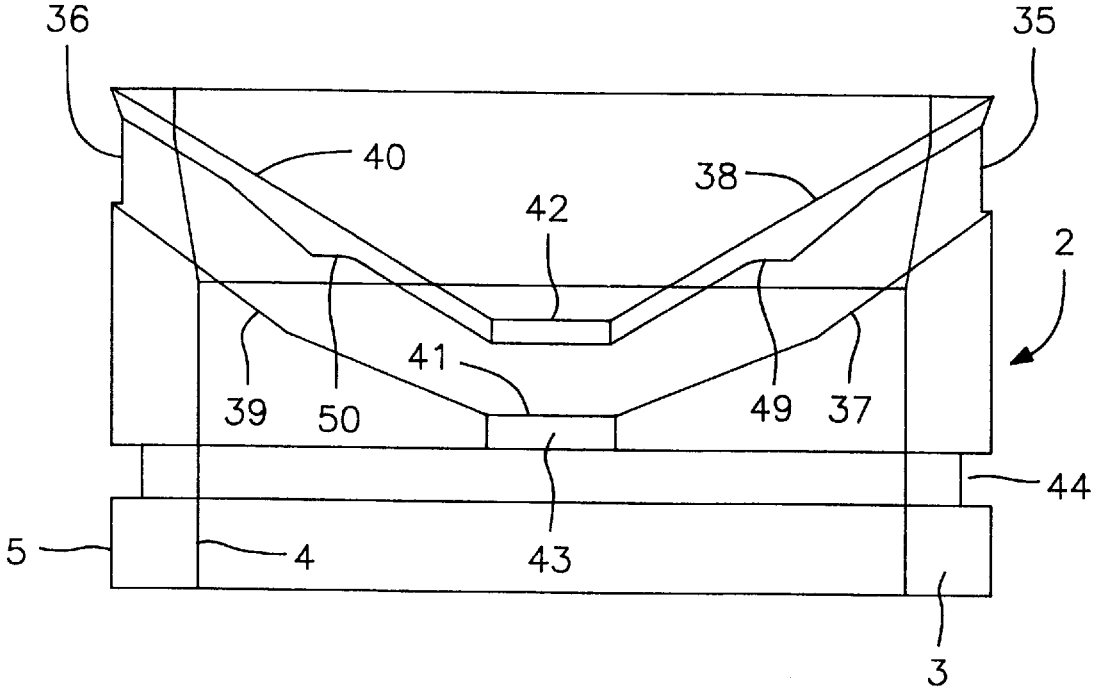
FIG. 16 is a cross sectional view of a container for use with a closure for use with a tamper proof structure in accordance with a sixth embodiment of the invention.
Figure 17:
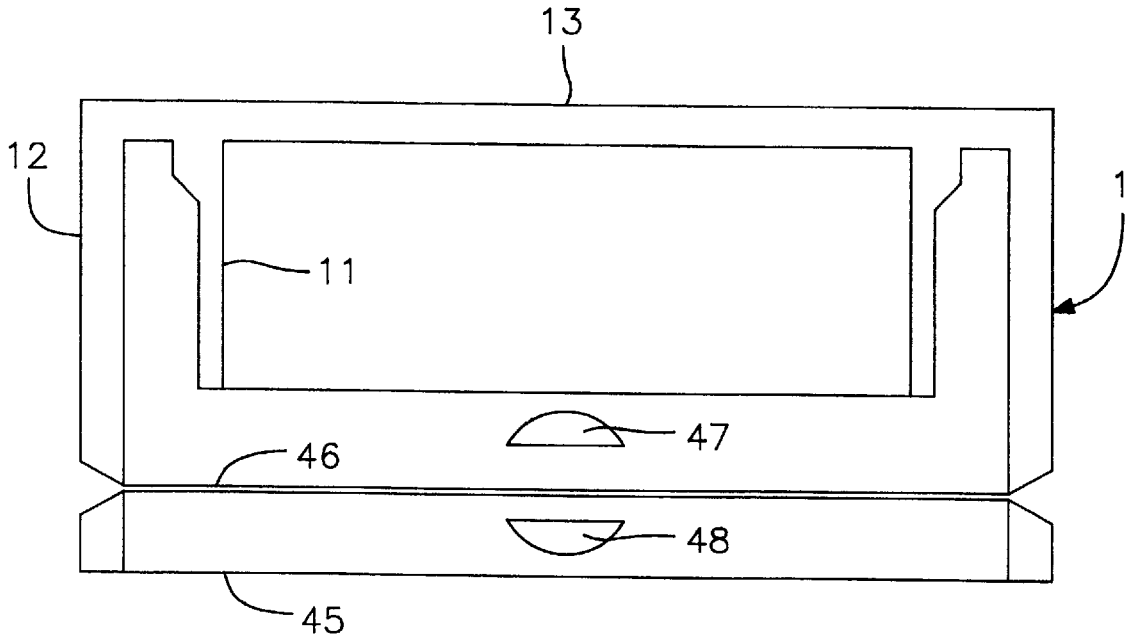
FIG. 17 is a cross sectional view of a closure for use with the container illustrated in FIG. 16.
Figure 18:
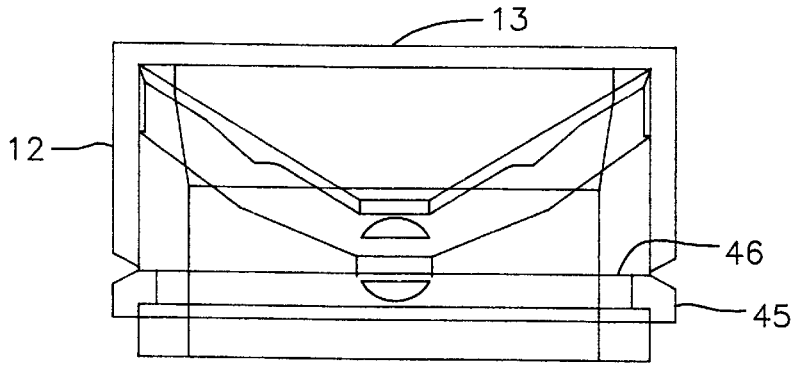
Figure 19:
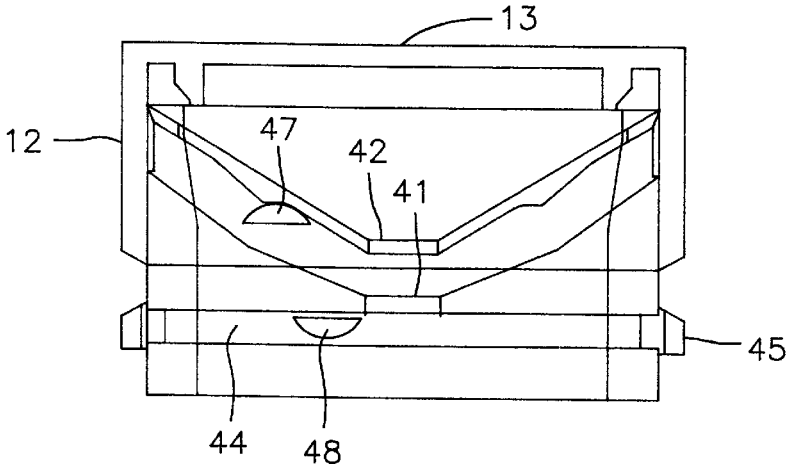
Figure 20:
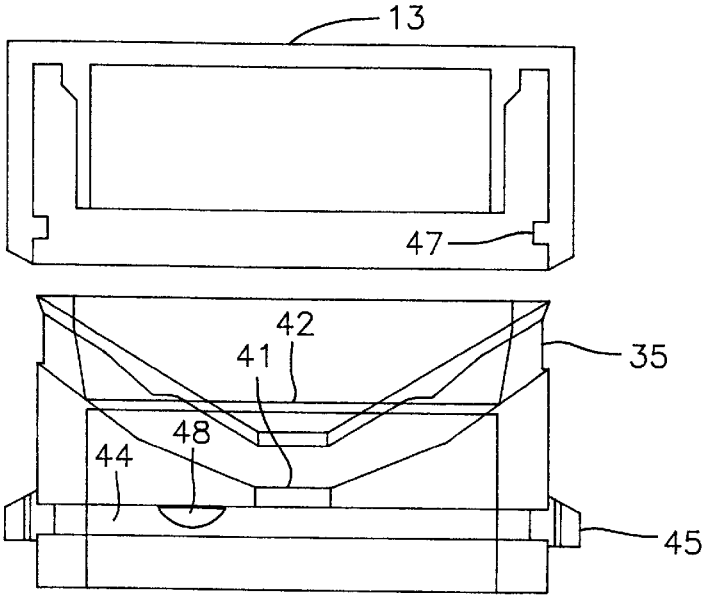
Figure 21:
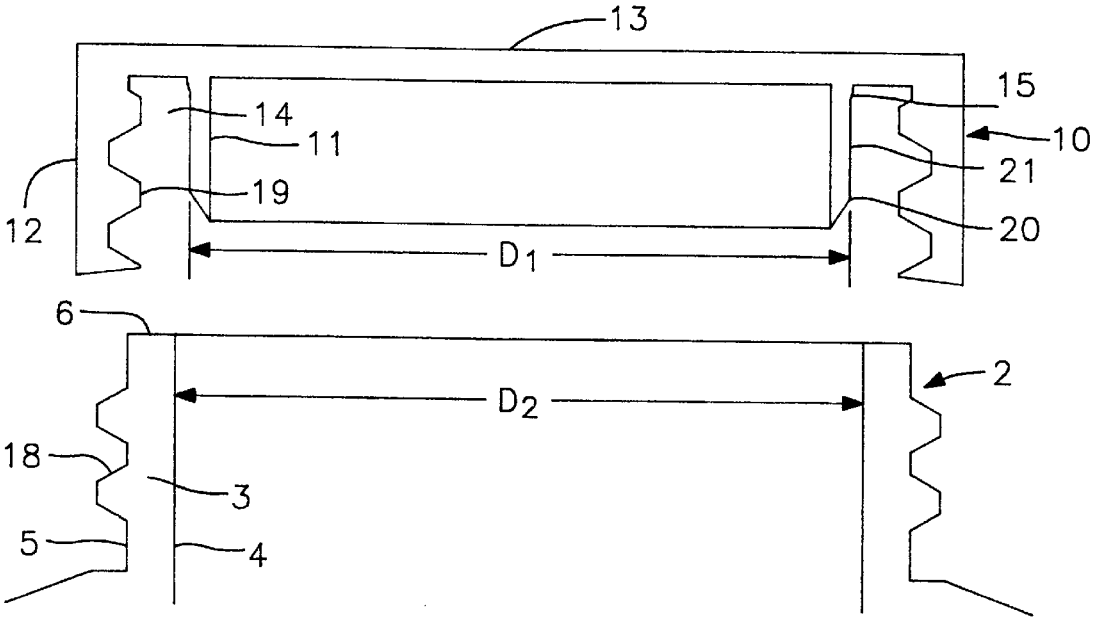
Figure 22:
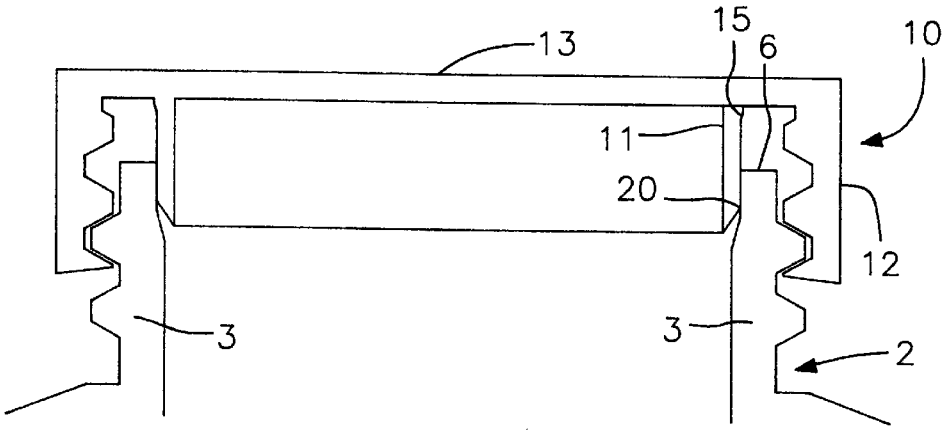
Figure 23:
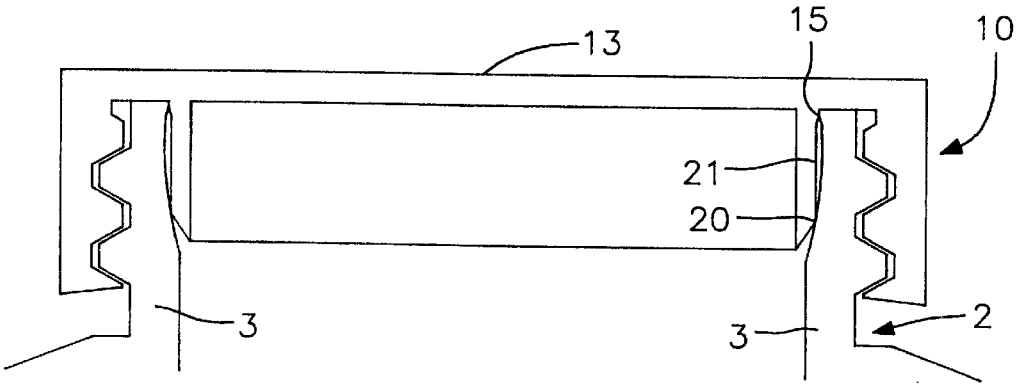
Figure 24:
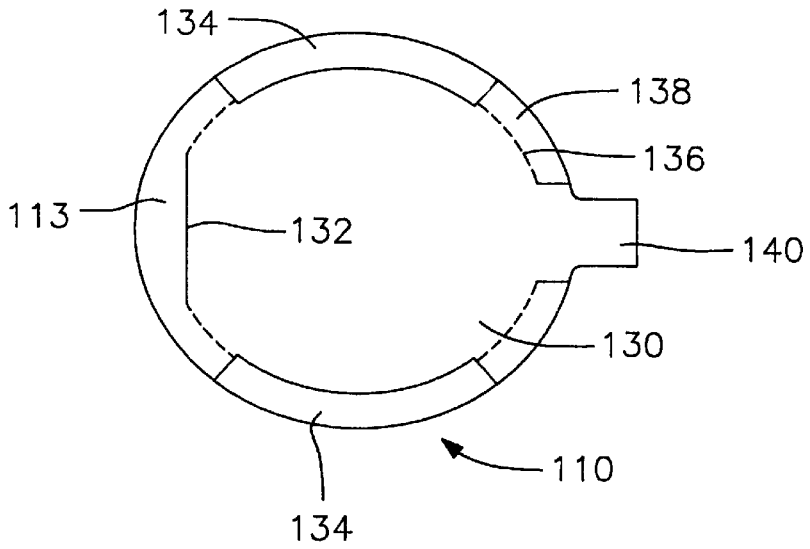
Figure 25:
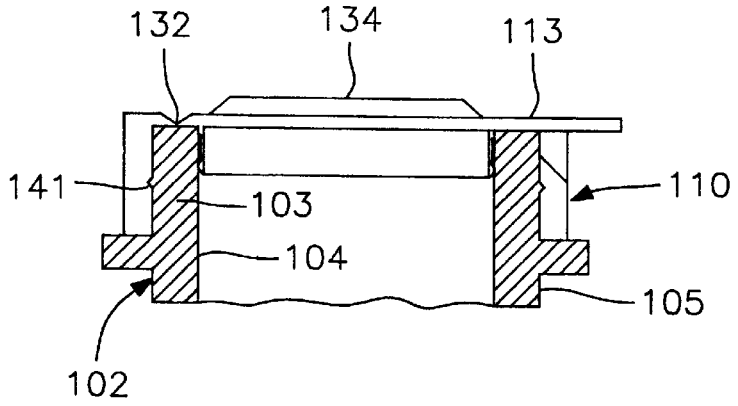
Figure 26:
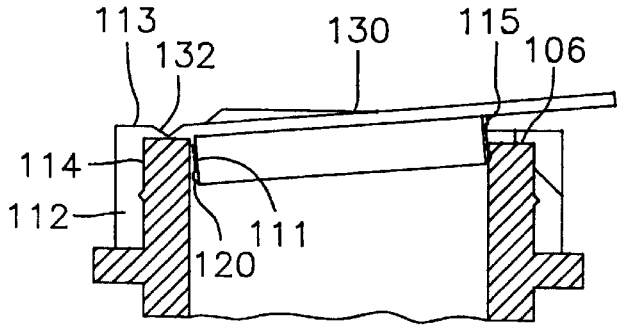
Figure 27:
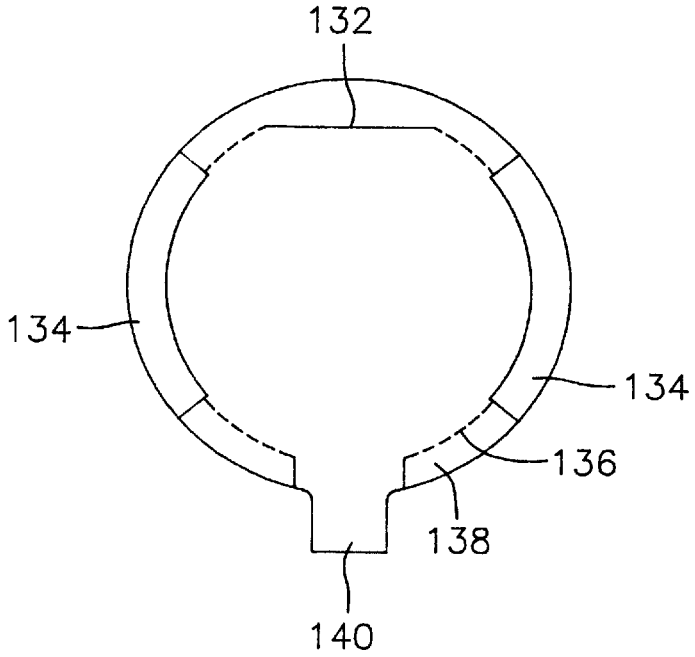
Figure 28:
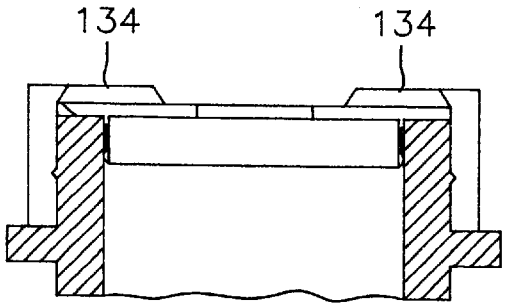
Figure 29:
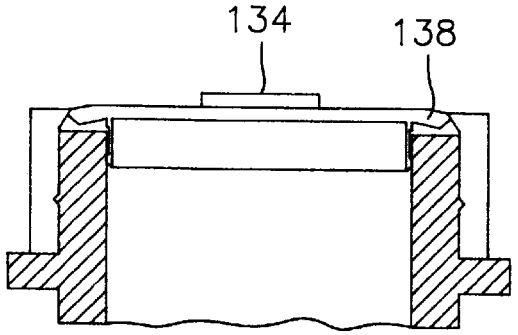

FIG. 18 is a cross sectional view of the container and closure illustrated in FIGS. 16 and 17 with the closure sealed and locked to the container, FIG. 19 is a cross-sectional view of the container and closure illustrated in FIGS. 16 and 17 with the closure partly removed from the container; and FIG. 20 is a similar view to FIG. 19 with the closure rotated through an angle of 180° and almost removed from the container FIG. 21 is a cross-sectional view of a closure and container according to another embodiment of the invention before the closure is applied to the container;

FIG. 22 is a cross-sectional view of the closure and container illustrated in FIG. 21 with the closure partly applied to the container;

FIG. 23 is a view similar to FIG. 2 with the closure sealed and locked to the container;

FIG. 24 is a plan view of a container closure according to another embodiment of the present invention;

FIG. 25 is a schematic side elevation of the embodiment of FIG. 24;

FIG. 26 is a similar view of that of FIG. 25 with the end cap partially open;

FIG. 27 is a further plan view of the cap shown in FIG. 25;

FIG. 28 is an end elevation of the cap shown in FIG. 27;

FIG. 29 is a side elevation with the end cap partially open; and

Figure 30:
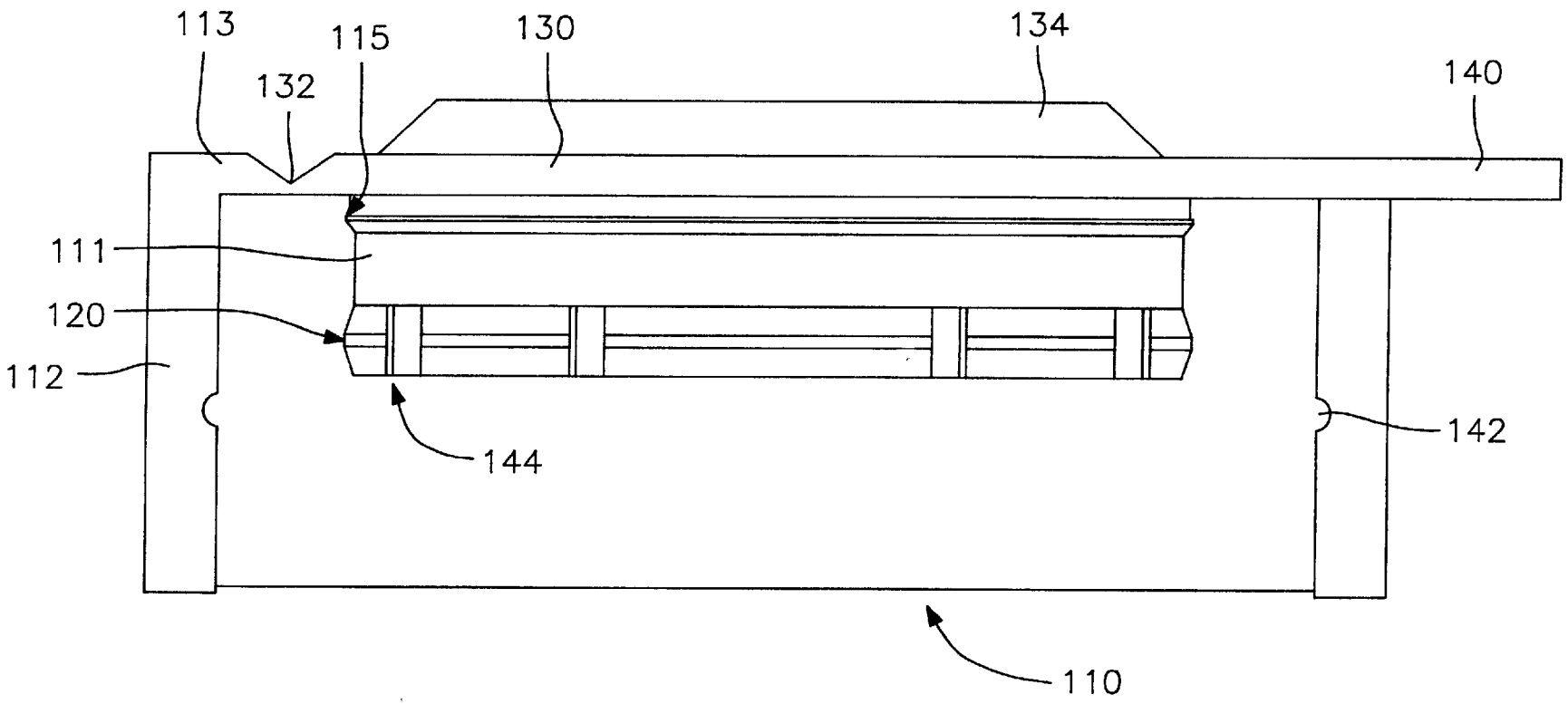

FIG. 30 is a more detailed side elevation of a further modified form of closure.

Referring now to the drawings, and with particular reference to FIGS. 1 to 4 the container 2 (FIG. 2) has an outlet formed by a wall 3 with inner and outer surfaces 4 and 5 terminating in a rim 6. The outlet has regions of different cross-sectional areas 7 and 8 connected by an inclined surface 9. As will be apparent from FIG. 2, the cross-sectional area 8 is greater than the cross-sectional area 7 and the thickness of the wall 3 in tile area 8 is less than the thickness of the wall in the area 7. The junction of the surface 4 with the inclined surface 9 forms a shoulder 10.

The closure (FIG. 1) has an inner and outer skirt 11 and 12 connected at an upper end thereof with an annular disc 13 connecting said inner skirt and forming with said skirts 11 and 12 the closure 1. The inner and outer skirts defining between them a circumferential slot 14 which when the closure is applied to the container, receives the container outlet.

The outer surface of the inner skirt 11 is stepped outwardly adjacent the annular disc 13 to provide a sealing zone or band 15. The relative diameters of the container, the inner and outer skirts 11 and 12 and the thickness of the container wall in the area 8 is such that when the closure 1 is applied to the container 2 with the inner skirt 11 in contact with the inner wall 4 and the closure 1 seated on the container rim 6, the inner wall 4 of the container adjacent the sealing band 15 is forced inwardly into tight sealing engagement with the wall 4 thereby effectively sealing the closure to the container.

The closure may be locked to the container in the manner illustrated in FIGS. 1 to 6.

In the case of the embodiment illustrated in FIGS. 1 to 4 the container is provided with a circumferential slot 17 and the surface S above the slot is threaded as at 18.

Figure 4:
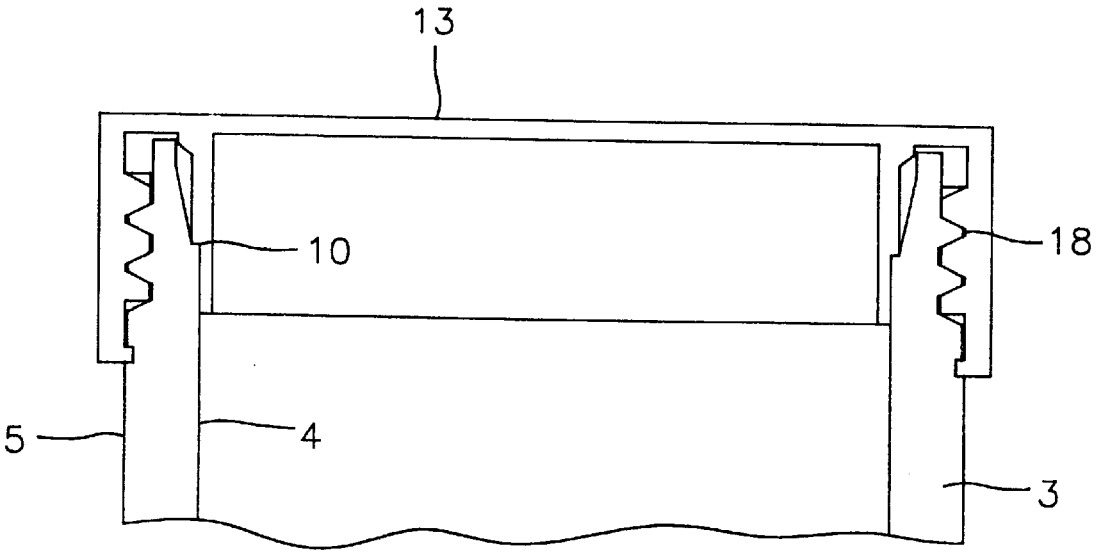
FIG. 4 is a view similar to FIG. 3 with the closure sealed and locked to the container.

The inner surface of the outer skirt 12 of the closure 1 has a threaded section 19 which is adapted to mate with the threaded section 18 on the container and the free end of the outer skirt 12 is provided with an inwardly directed flange 16 whereby the closure is secured and locked to the container as clearly illustrated in FIG. 4. In this position the outer skirt 12 flexes outwardly thus permitting the flange 16 to lock into the circumferential slot 17.

The closure and container illustrated in FIGS. 1–4 is particularly suitable for accommodating pressurised fluids.

In those cases where pressurised fluid is housed within the container, the skirt 11 is forced outwardly below the inclined surface 9 into a tight secondary seal adjacent the shoulder 10 of the container, thereby relieving the closure of excess loading forces caused by pressure in the container, relieving the mated threaded sections of heavy loading which means that the closure can be applied to and locked to the container with minimum of effort and also permitting a controlled release of pressure from the container as it is opened. In certain cases a vent slot (not shown) passes through the threads to relieve gas pressure as the container is opened.

Figure 5:
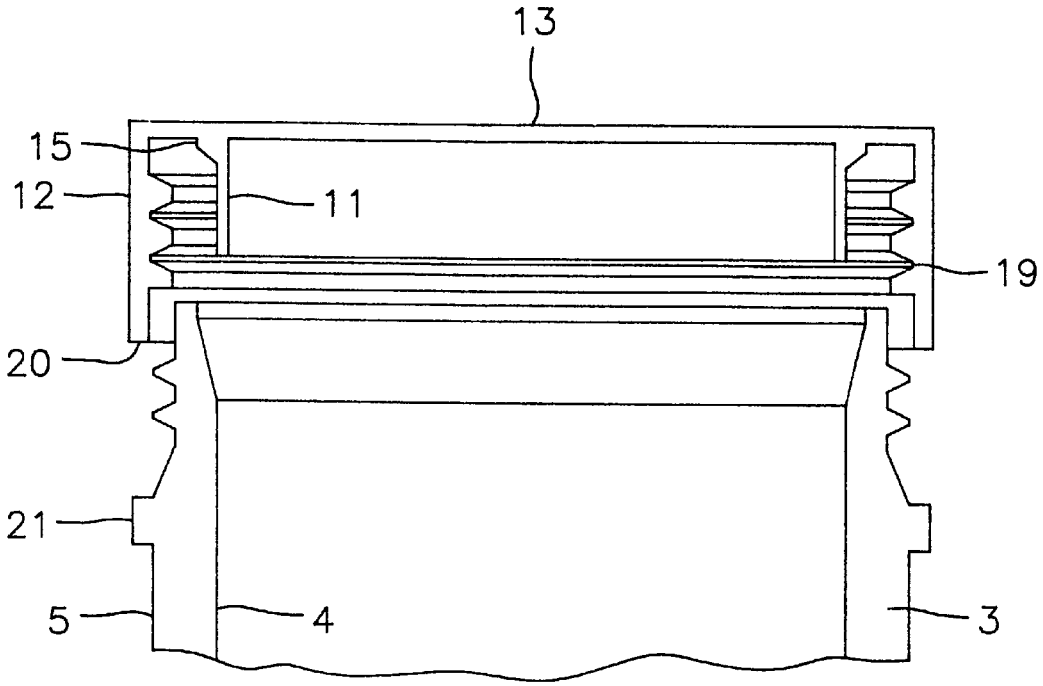
FIG. 5 is a cross-sectional view of the closure and container in the unsealed and unlocked position in accordance with a second embodiment of the invention.
Figure 6:
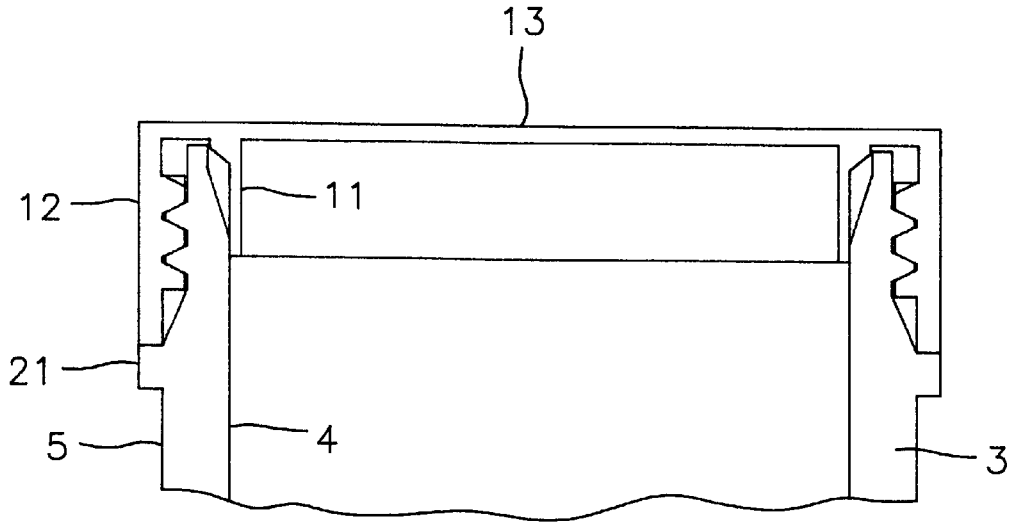
FIG. 6 is a cross-sectional view of the closure and container illustrated in FIG. 5 in the sealed and locked condition.
Figure 7:
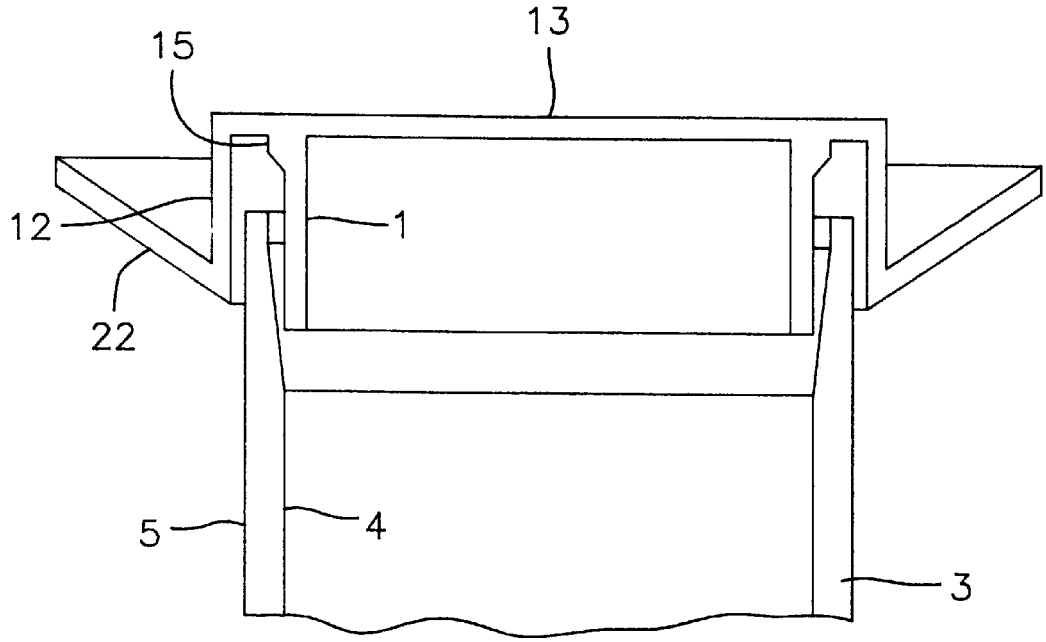
FIGS. 7 and 8 are cross-sectional views of a closure and container similar to those illustrated in FIGS. 5 and 6 but illustrating a third embodiment of the invention.

Referring to the embodiment of the invention illustrated in FIGS. 5 and 6, the closure and container of the embodiment are similar to the embodiment illustrated in FIGS. 1 to 4. In the case of FIG. 5 and 6 embodiment the flange 16 on the skirt 12 and the circumferential slot 17 on the surface 5 of the container are omitted and the bottom edge 20 of the skirt 12 abuts against a collar 21 formed on the surface 5 of the container, thereby isolating the threads from any contact with water or other fluid in which the container may be immersed.

Figure 8:
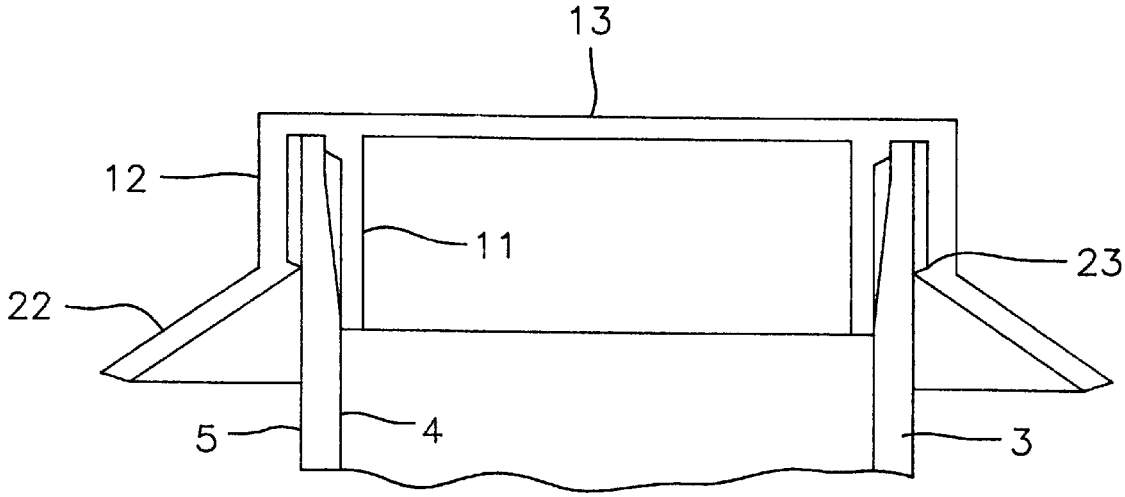

In the case of the embodiment illustrated in FIGS. 7 to 10, these Figures illustrate an alternative system whereby the closure is locked to the container. To this end the outer skirt 12 is provided with a frusto-conical locking skirt 22 extending circumferentially about the bottom edge thereof, the locking skirt 22 is movable between an unlocked and locked position. In the unlocked position the locking skirt converges towards the skirt 12 thereby presenting a smooth inner surface to the surface 5 of the container and thereby permitting the closure to be applied to and removed from the container 2, however when the locking skirt 22 is forced downwardly and diverges away from the skirt 12, a locking bead 23 is generated at the junction of the skirt 12 and the locking skirt 22 which tightly engages the surface 5 of the container to lock the closure to the container as illustrated in FIG. 8.

Figure 9:
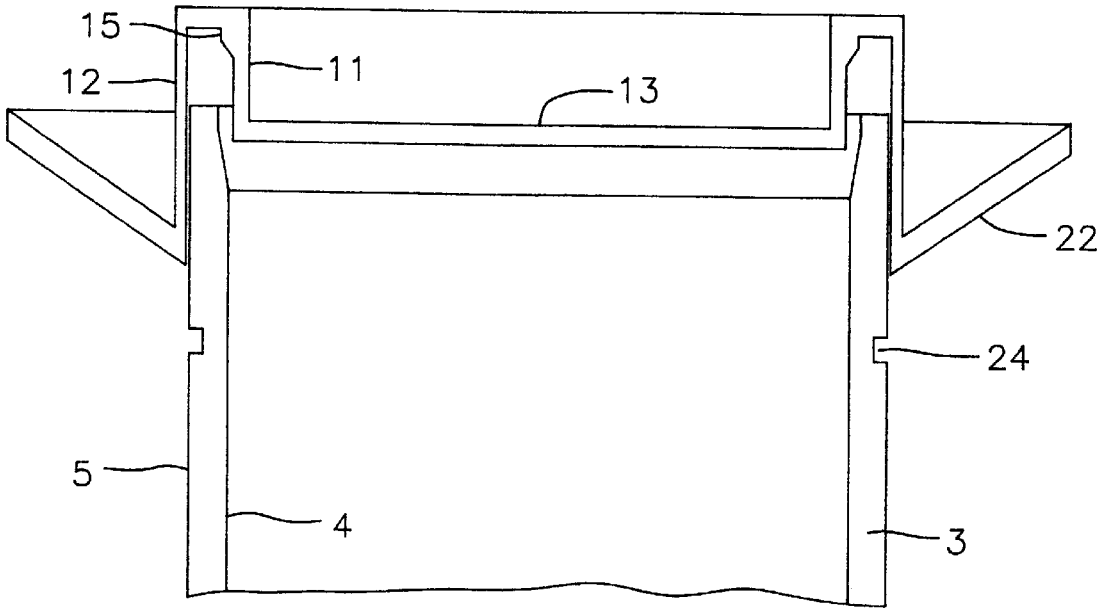
FIG. 9 is a cross-sectional view of a closure partly applied to a container in accordance with a fourth embodiment of the invention.
Figure 10:
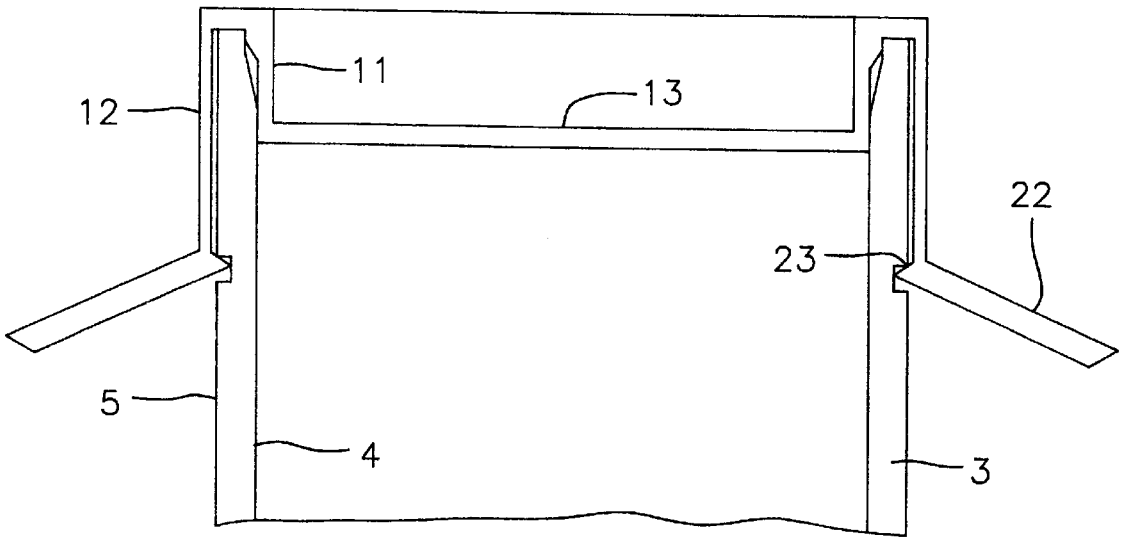
FIG. 10 is a cross-sectional view of the closure and container illustrated in FIG. 9 in a sealed and locked condition.
Figure 11:
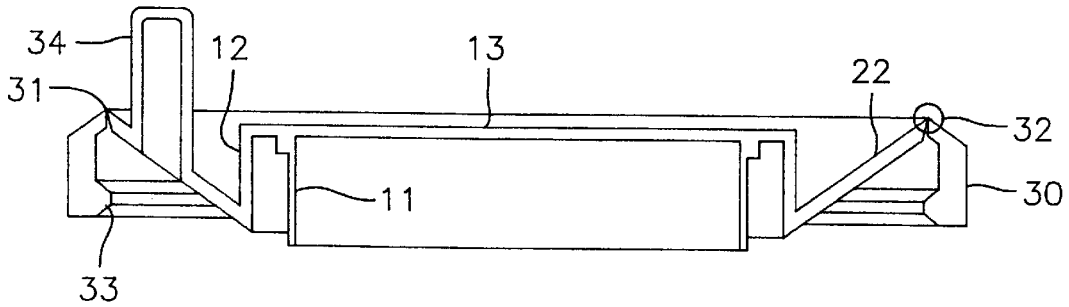
FIG. 11 is a cross-sectional view of the closure illustrating a tamper evident structure in accordance with a fifth embodiment of the invention.
Figure 12:
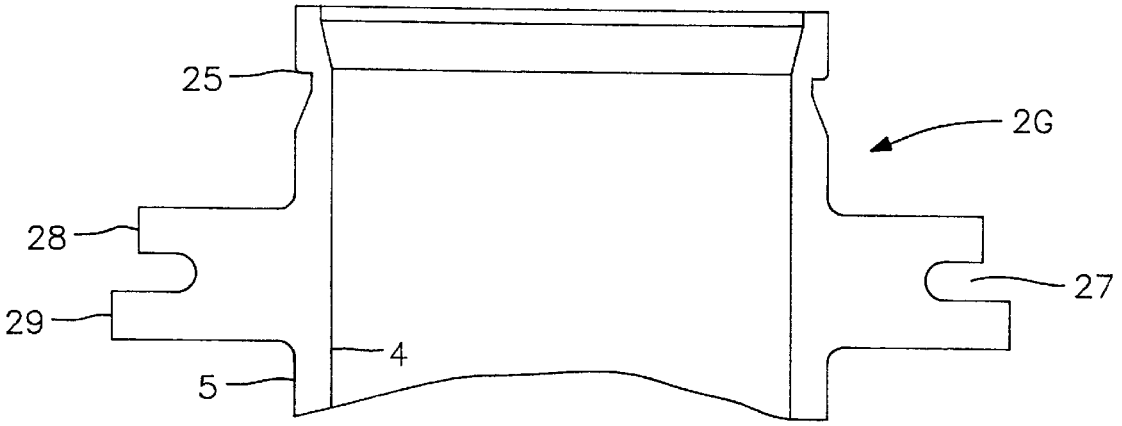
FIG. 12 is a cross-sectional view of a container for use with the closure illustrated in FIG. 11.

With reference to the embodiment of the invention illustrated in FIGS. 9 and 10, it will be noted that the annular disc 13 connects the bottom edge of the inner skirt 10 rather than at the top thereof as illustrated in the previous embodiments.

It will be further noted from FIGS. 9 and 10 that a circumferential locking slot 24 is formed in surface 5 of the container to provide a seat which receives the bead 23 to assist in locking the closure to the container.

Referring now to the embodiment of the invention illustrated in FIGS. 11 to 15.

The container is provided with a shoulder 25 and a circumferentially outwardly extending collar designated generally by the reference 26. The collar is provided with a circumferential inwardly directed slot 27 in its edge thereby defining an upper limb 28 and a lower limb 29. The upper limb 28 being shorter than the lower limb 29. The free end of the frusto-conical locking skirt 22 on the closure has a tamper evident band 30 secured thereby by a fracture line 31 which extends circumferentially about the locking skirt 20 and which includes a hinge section 32. The lower edge of the tamper proof band 30 has an inwardly directed protuberance 33 which, when the band is applied to the container, seats in the slot 27 and a finger tag 34 is provided on the frusto-conical locking skirt 22, the purpose of which will be explained hereafter.

Figure 13:
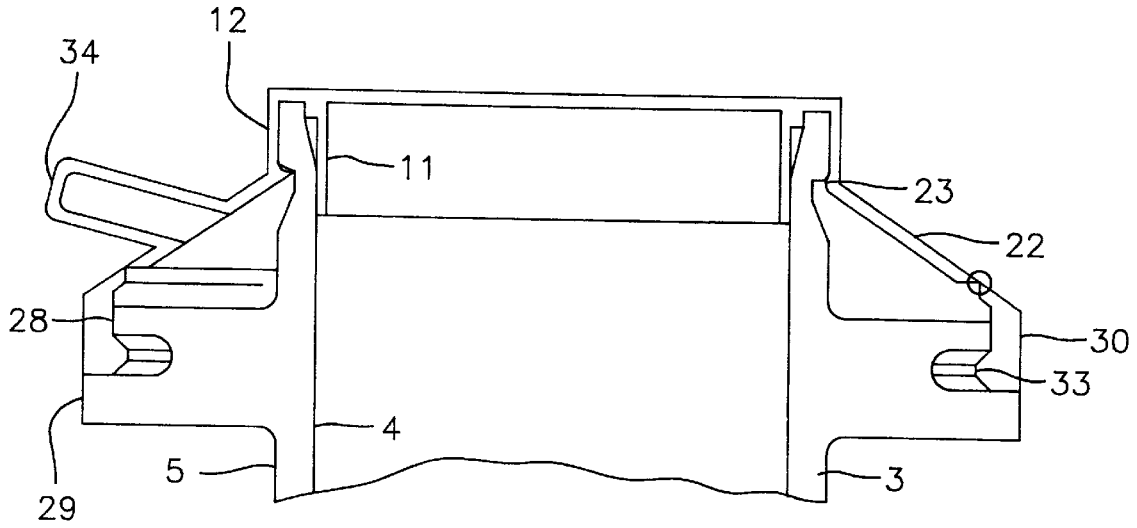
FIG. 13 is a cross-sectional view of the closure and container illustrated in FIGS. 11 and 12 with the closure sealed and locked to a container.
Figure 14:
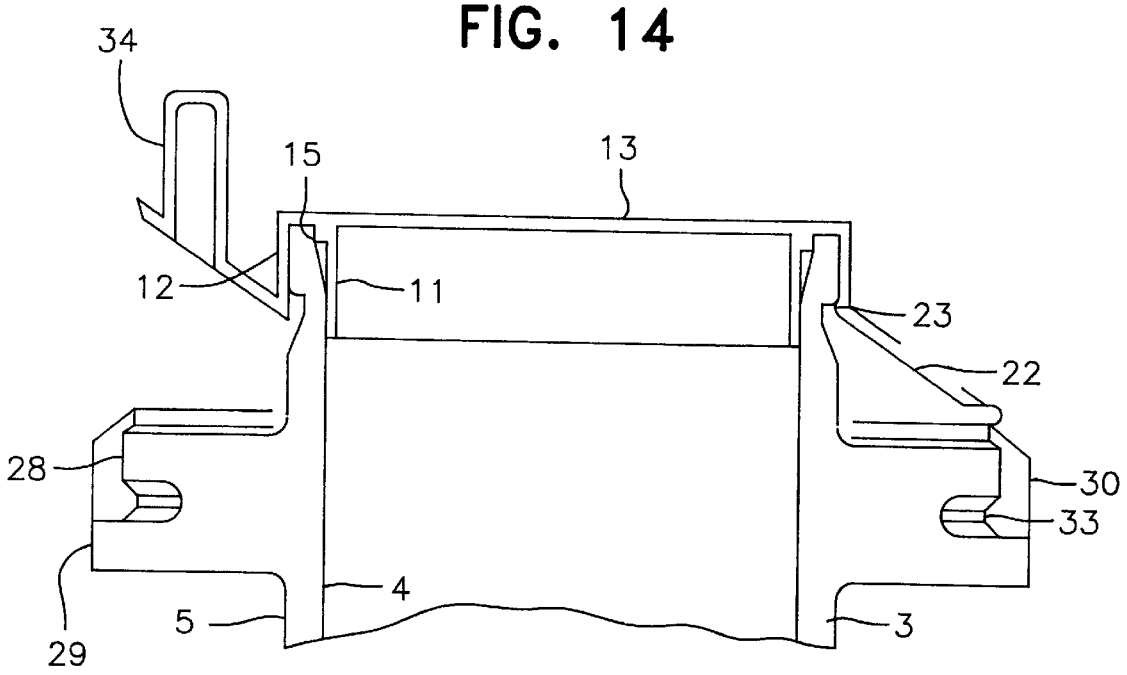
FIG. 14 is a similar view to FIG. 13 with the closure and container in an unlocked condition.
Figure 15:
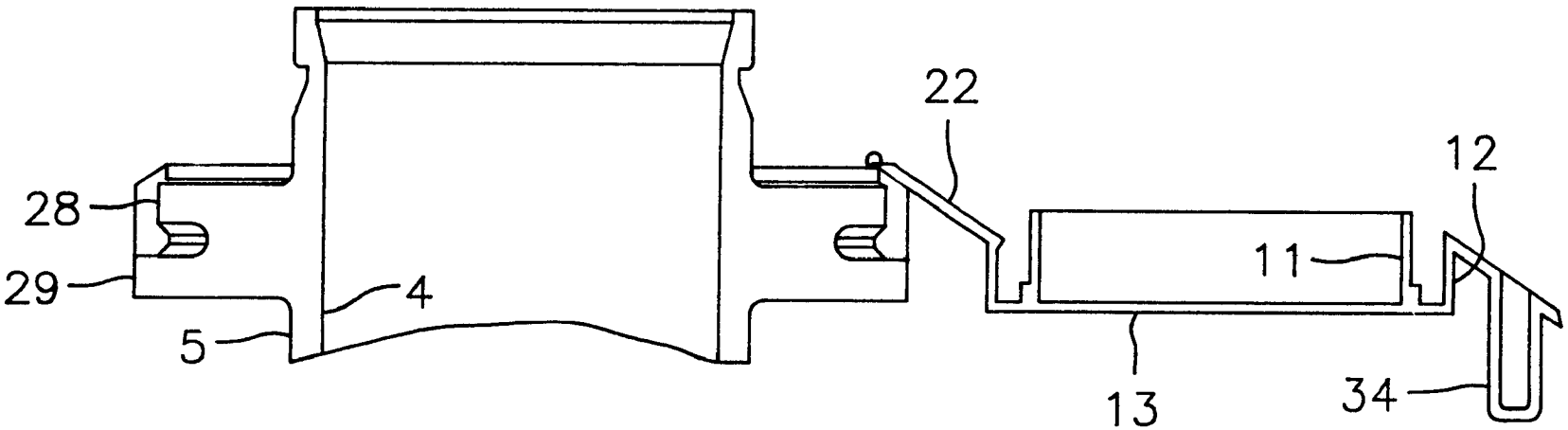
FIG. 15 is a similar view to FIG. 14 with the closure and container in fully opened condition.

With the closure applied to container with the conical locking skirt 22 in the upper or unlocked position as illustrated in FIG. 14, the closure can be freely applied to and removed from the container, however, when the conical locking skirt 22 is in the locked position as illustrated in FIG. 13, with the protuberance 33 entered into the slot 27, the closure is sealed and locked to the container as previously described, and the closure can now only be opened by breaking the fracture line 31. This action is facilitated by the use of the finger tag 34. When this happens the cap can be swung about hinge 32 to open the container as illustrated in FIGS. 14 and 15 and whilst it is possible to re-seal and lock the closure to the container, it is not possible to reconnect the fracture line 31, and thus it is evident to the user that the container has been opened.

By controlling the hinging movement of the closure it is possible to control the rate of release of gas from the container.

Referring now to the embodiment of the invention illustrated in FIGS. 17 to 20 in which the same reference numbers have been given to like parts illustrated in the previous embodiments.

The closure 1 seals to the container 2 in the same manner as described with reference to the embodiment illustrated in FIGS. 1 and 2 and for this reason no further description of the seal arrangement is necessary.

The surface 5 of each half of the container 2 is provided with two downwardly directed "V" shaped channels 35 and 36 having walls 37 and 38 and 39 and 40. The respective channels 35 and 36 are connected by a transverse section 41 having walls 42 and 43. Positioned below and spaced from the V-shaped channels 35 and 36 is a transverse channel 44 and the walls 42 and 43 of the transverse section 41 are inclined in the direction of the respective channels as illustrated in FIG. 16 to facilitate the entry of lock members 47 and 48 on the closure 1 into the respective channels.

The closure 1 has a tamper evident skirt 45 extending downwardly from the outer skirt 12 and connected thereto by a fracture line 46. Located on the inner surface of the wall 12 is and inwardly directed projection or lock member 47 and located on the inner surface of the tamper evident skirt 45 is a similar lock member 48.

The spacing between the transverse section 41 of the "V" shaped channels 37 and 39 and the transverse channel 44 is such that when the lock members 47 and 48 are engaged in the respective channels as illustrated in FIG. 18, the closure 1 is sealed and locked to the container with the tamper evident skirt secured to the outer skirt 12.

As the closure 1 is rotated relative to the container 2 the lock member 47 moves up either of the channels 35 and 36 depending on which way the closure is rotated. This movement breaks the fracture line 46 which separates the tamper evident skirt from the closure as illustrated in FIG. 19. The rotational movement normally causes a limited movement of the lock member 48 in the transverse channel 44 also as illustrated in FIG. 19. In this condition it is clearly apparent that the closure has been or has been partly removed from the container. It may be desirable to provide for the controlled release of gas pressure from the container. For this purpose the walls 38 and 40 of the channels 35 and 36 are provided with cam surfaces 49 and 50 to which are engaged by the lock member 47 to facilitate the slow release of gas pressure from the container.

FIG. 20 illustrates the closure rotated through an angle of 180° relative to the container.

It will be appreciated that the locking arrangement is repeated on opposite sides of the container.

Referring to FIGS. 21 to 23 of the drawings, the container 2 has an outlet formed by a wall 3 with inner and outer surfaces 4 and 5 terminating in a rim 6 at the free end thereof.

The closure has an inner and outer skirt 11 and 12 connected at an upper end thereof with an end wall 13 connecting said inner skirt and forming with said skirts 11 and 12 the closure 1. The inner and outer skirts defining between them a circumferential slot 14 which when the closure is applied to the container, receives the container outlet. The inner skirt includes a projection 20 at its free end defining a deflecting section which as shown has a relatively sharp engagement edge.

The outer surface of the inner skirt 11 is stepped outwardly adjacent the end wall 13 to provide a sealing section or band 15. The relative diameters of the container, the inner and outer skirts 11 and 12 and the thickness of the container wall in the area 8 is such that when the closure 1 is applied to the container 2 with the inner skirt 11 in contact with the inner wall 4 and the closure 1 seated on the container rim 6, the inner wall 4 of the container adjacent the sealing band 15 is forced inwardly into tight sealing engagement with the wall 4 thereby effectively sealing the closure to the container. The sealing section 15 and deflecting section 20 project from the outer surface of the inner skirt thereby forming a recess 21 therebetween.

Figure 1:
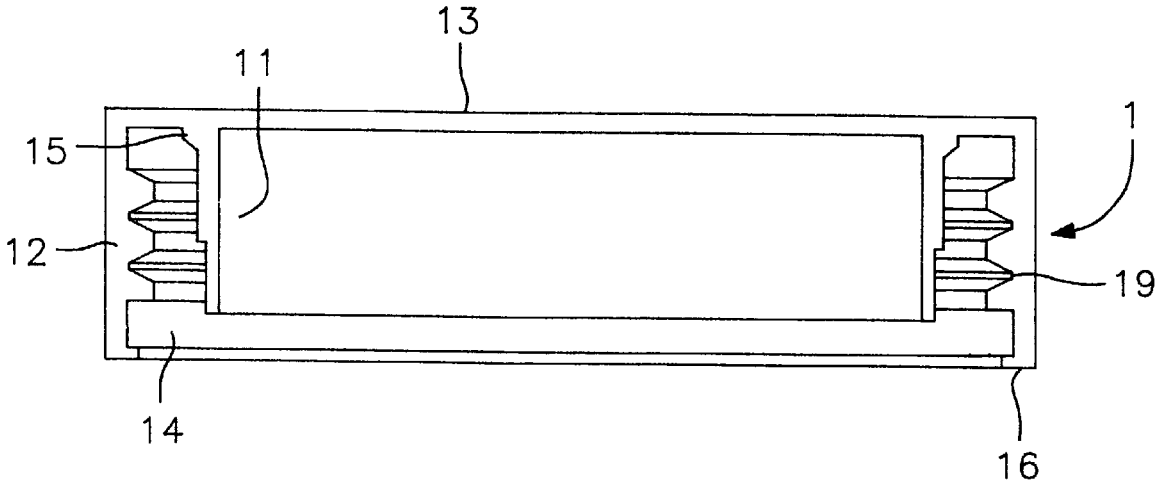
FIG. 1 is a cross-sectional view of a closure in accordance with a first embodiment of the invention.
Figure 3:
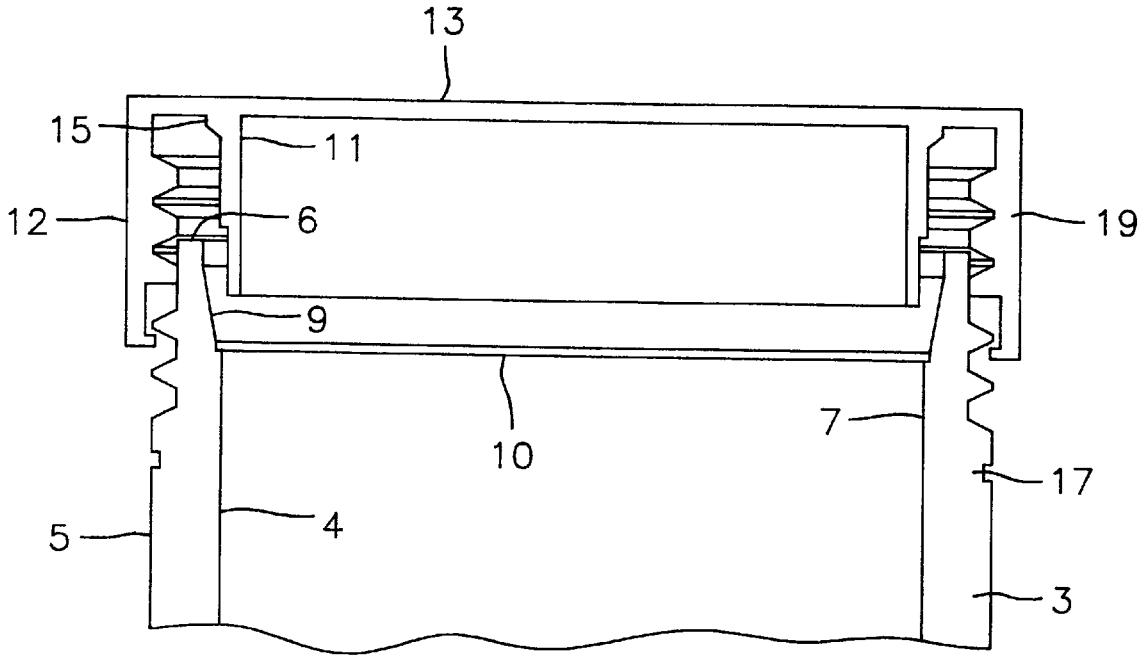
FIG. 3 is a cross-sectional view of the closure and container illustrated in FIGS. 1 and 2 with the closure partly applied to the container.

The closure may be locked to the container in the manner illustrated in FIGS. 1 to 3. When the closure is first applied to the container, the projection 20 engages the inner surface 4 of container 2, because diameter $D_1$ is greater than diameter $D_2$. The projection 20 carries the wall 3 to distort as shown in exaggerated fashion in FIGS. 2 and 3 so that the free end of wall 3 is urged inwardly.

The inner surface of the outer skirt 12 of the closure 1 has a threaded section 19 which is adapted to mate with the threaded section 18 on the container.

Referring to FIGS. 24 to 30 of the drawings as is the case with the first embodiment, the container 102 has an outlet formed by a wall 103 with inner and outer surfaces 104 and 105 terminating in a rim 106 at the free end thereof.

The closure 110 has an end wall 113 with a hinged end cap 130 therein, the end cap having inner and outer skirts 111 and 112 projecting from the end cap 130. The end cap 130 is hinged at 132 for hinged movement between open and closed positions. The inner and outer skirts define between them a circumferential slot 114 which when the closure is applied to the container and the end cap is closed and receives the container outlet. The inner skirt includes a projection 120 at its free end defining a deflecting section which as shown has a relatively sharp engagement edge.

The outer surface of the inner skirt 111 is stepped outwardly adjacent the end wall 113 to provide a sealing section or band 115. The relative diameters of the container, the inner and outer skirts 111 and 112 and the thickness of the container wall in the area 108 is such that when the closure is applied to the container with the inner skirt 111 in contact with the inner wall 104 and the closure seated on the container rim 106, the inner wall 104 of the container adjacent the sealing band 115 is forced inwardly into tight sealing engagement with the wall 104 thereby effectively sealing the closure to the container. The sealing section 115 and deflecting section 120 project from the outer surface of the inner skirt thereby forming a recess 121 therebetween.

There closure further includes cheek plates 134 which contour and dimension progressive controls release of pressurised gas during cap opening procedure. They also keep cap open during pouring. On resealing they prevent vertical movement of the cap and sealing skirt, when tamper evidence perforations 136 are broken. In addition they help protect the cap from impact damage. An outer flange 138 is flexible to accommodate bending when the end cap is pivoted about hinge 132 during opening and closing. A lifting lug 140 which is thumb operated is provided to assist in opening the end cap.

There may also be provided a locking bead 141, which co-operates with a recess 142 to fix the closure to the neck. The inner skirt 111 may be fitted with vertical slots or splines 144 to aid gas release when the lid is partially opened the skirt is canted to start releasing gas pressure.

The invention has been described and illustrated with reference to circular containers. It will be apparent that the invention is not limited thereto and the teachings of the invention are equally applicable to containers which are non-circular.

I claim:

1. A container and a removable closure therefor, which can be applied to the container in a sealing position, said container having an outlet with an inner and outer surface terminating at one end in a rim, said closure having an end wall with an inner and outer skirt extending therefrom, said inner and outer skirts defining between them a slot which when the closure is applied to the container and in the sealing position receives the container rim, the inner skit having a deflecting section in the region of the free end of the inner skirt, and a sealing section spaced from the deflecting section there being a space between the inner skirt and the outlet inner surface between the deflecting and sealing section, the cross-sectional areas of said deflecting section being greater than the cross-sectional area of the inner surface of the outlet such that when the closure is applied to said container the deflecting section of the inner skirt engages the inner surface of said outlet and causes a deflection thereof and the sealing section is caused to engage the inner surface and the rim into sealing engagement with said sealing zone to seal said closure to said container.

2. A container according to claim 1 wherein the container outlet is formed of PET or high density polypropylene.

3. A container and a removable closure therefor according claim 1 wherein primary lock means are provided on said container which co-operate with primary lock means on the closure to lock said closure to said container.

4. A container and a removable closure therefor as claimed in claim 3 wherein said primary lock means comprises a threaded section on the inner surface of the outer skirt of said closure which engages a corresponding threaded section on the outer surface of said container.

5. A container according to claim 4 wherein said end wall of said closure has an opening therein and a hinged cap section in the end wall adapted to be hingedly moved between open and closed positions, wherein in the closed position it closes the opening in the end wall.

6. A container and a removable closure therefor as claimed in claim 5 wherein said primary lock means comprises a threaded section on the inner surface of the outer skirt of said closure which engages a corresponding threaded section on the outer surface of said container.

7. A container according to claim 5 wherein said inner skirt has slots generally vertically disposed.

8. A container and removable closure therefor according to claim 1 wherein said deflecting section comprises a projection on the outer surface of the inner skirt.

9. A container and removable closure therefor according to claim 8 including a tapered leading edge at the free end of the inner skirt.

10. A container and removable closure therefor according to claim 8 wherein said sealing section extends into said slot thereby defining a recessed zone between the sealing section and the deflecting section which effects a progressive release of the closure from the container to effect a controlled release of gas from the container.

11. A container and removable closure therefor according to claim 10 including a tapered leading edge at the free end of the inner skirt.

12. A container and a removable closure therefor, which can be applied to the container in a sealing position, said container having an outlet with an inner and outer surface terminating at one end in a rim, said outlet having two regions of different cross-sectional areas joined by an inclined surface with the cross-sectional area of said region adjacent the rim being greater than the cross-sectional area of said region inwardly of said inclined surface, said closure having an inner and outer skirt connected on upper end thereof with an annular disc connecting said inner skirt and thereby forming said closure, said inner and outer skirts defining between them a slot which when the closure is applied to the container and in a sealing position receives the container rim, the inner skirt having a deflecting section in the region of the free end of the inner skirt, and a sealing zone extending into said slot spaced from the deflecting section there being a space between the inner skirt and the outlet inner surface between the deflecting and sealing section, the cross-sectional areas of said deflecting section being the greater than the cross-sectional area of the inner surface of the outlet such that when the closure is applied to said container the deflecting section of the inner skirt engages the inner surface of said outlet and causes a deflection thereof and the sealing section is caused to engage the inner surface and the rim into sealing engagement with said sealing zone to seal said closure to said container.

13. A container according to claim 12 wherein the container outlet is formed of PET or high density polypropylene.

14. A container and a removable closure therefor as claimed in claim 12 wherein the inner skirt is stepped inwardly adjacent its bottom edge to form a shoulder which engages with said inclined surfaces when the closure is applied to the container to constitute a secondary sealing area which as the closure is removed from the container effects a progressive release of the closure from the container to effect a controlled release of gas from said container.

15. A container and a removable closure therefor as claimed in claim 14 wherein primary lock means are provided on said container which co-operate with primary lock means on the closure to lock said closure to said container.

16. A container and a removable closure therefor as claimed in claim 12 wherein secondary lock means are provided on said container which co-operate with secondary lock means on the closure to lock said closure to said container.

17. A container and a removable closure therefor as claimed in claim 16 wherein said secondary lock means comprises an inwardly directed flange on the outer skirt of said closure which engages a circumferential slot on the outer surface of said container to lock said closure to said container.

18. A container according to claim 12 wherein said end wall of said closure has an opening therein and a hinged cap section in the end wall adapted to be hingedly moved between open and closed positions, wherein in the closed position it closes the opening in the end wall.

19. A container according to claim 18 wherein said inner skirt has slots generally vertically disposed.

20. A container and a removable closure therefor as claimed in claim 12 wherein primary lock means are provided on said container which co-operate with primary lock means on the closure to lock said closure to said container.

21. A container and a closure therefor as claimed in claim 20 wherein said primary lock means comprises a frusto-conical locking skirt which extends circumferentially about the outer skirt of said closure from a bottom edge thereof, said locking skirt being movable between an unlocked and locked position, in the unlocked position the locking skirt converges towards said outer skirt thereby permitting the closure to be applied to and removed from said container, in the locked position this locking skirt extends away from said outer skirt and a locking bead is generated at the junction of said conical skirt with said outer skirt which engages the outer surface of said container to lock the closure to said container.

22. A container and a closure therefor as claimed in claim 20 wherein the outer surface of said container is provided with a shoulder below said rim with a circumferential outwardly extending collar located below said shoulder said collar being provided with a circumferential inwardly slot having an upper limb and a lower limb, the upper limb being shorter than the lower limb, said locking means comprising a frusto-conical locking skirt extending circumferentially about the outer skirt of said closure from a bottom edge thereof, said locking skirt being movable between an unlocked and locked position, in the unlocked position the locking skirt converges towards said outer skirt thereby permitting the closure to be applied to and removed from said container, in the locked position this locking skirt extends away from said outer skirt and a locking bead is generated at the junction of said conical skirt with said outer skirt which on movement to a locking position seats below said shoulder to lock said closure to said container and tamper evident means on said locking skirt co-operating with said means on said container to indicate that the closure has been released from the container.

23. A container and closure therefor as claimed in claim 22 wherein said tamper evident means comprises a tamper evident band secured to said conical locking skirt by a fracture line which extends circumferentially about the locking skirt and includes a hinge portion, said tamper evident band having an inwardly directed protuberance which seats in said slot and finger tag on said frusto-conical skirt to facilitate the breaking of said tamper evident band from said frusto-conical skirt.

24. A container and a closure therefore as claimed in claim 20 wherein the outer surface of each side of the container is provided with two "V" shaped channels which are downwardly directed when the container is seated on its base, said "V" shape of channels being connected by a transverse section, a transverse channel on the outer surface of the container and positioned below said transverse section, the outer skirt of said closure having a tamper evident skirt secured thereto by a fracture line and lock means on the inner surface of said outer skirt and said tamper evident skirt adapted to lock with said transverse section and said transverse channel to lock the closure to said container, rotational movement of the closure relative to the container fracturing this fracture line and thereby permitting the closure to be removed from the container.

25. A container and a closure therefore as claimed in claim 24 wherein means are provided on the closure which co-operate with means on the container to permit the controlled release of gas from the container.

26. A container and a removable closure therefor as claimed in claim 20 wherein said primary lock means comprises a threaded section on the inner surface of the outer skirt of said closure which engages a corresponding threaded section on the outer surface of said container.

27. A container and a closure therefor as claimed in claim 26 wherein the outer skirt of said closure seats on a collar formed on the outer surface of said container.

28. A container and a closure therefor as claimed in claim 27 wherein a locking bead seat in a circumferential locking slot is formed in the outer surface of said container.

* * * * *